United States Patent [19]

Ramer

[11] 4,429,203

[45] Jan. 31, 1984

[54] ELECTROMAGNETIC MICROWAVE DIELECTRIC HEATED STEAM FLASH PLUG

[76] Inventor: James L. Ramer, Rte. 1, Box 382, Whitestown, Ind. 46075

[21] Appl. No.: 219,038

[22] Filed: Dec. 22, 1980

[51] Int. Cl.[3] ..... H05B 6/80; H05B 6/54

[52] U.S. Cl. ..... 219/10.55 A; 219/10.55 R; 219/10.51; 219/10.57; 219/10.81; 60/513; 60/659

[58] Field of Search ..... 219/10.51, 10.49 R, 219/10.57, 10.65, 10.73, 10.81, 10.55 R, 10.55 A, 10.47; 60/659, 682, 508, 513, 523; 123/549

[56] References Cited

U.S. PATENT DOCUMENTS

| | | | |
|---|---|---|---|
| 1,290,966 | 1/1919 | Garland . | |
| 1,744,288 | 1/1930 | Vorel . | |
| 2,542,589 | 2/1951 | Stanton et al. | 219/10.81 |
| 2,585,970 | 2/1952 | Shaw | 219/10.65 X |
| 2,602,134 | 7/1952 | Nelson | 219/10.55 X |
| 2,604,666 | 7/1952 | Bosomworth | 219/10.81 X |
| 2,622,184 | 12/1952 | Johneas | 219/10.51 |
| 2,806,931 | 9/1957 | Akerlof | 219/10.81 |
| 2,910,566 | 10/1959 | Smith | 219/10.55 X |
| 3,400,534 | 9/1968 | Michelson . | |
| 3,494,724 | 2/1970 | Gray | 219/10.55 R X |
| 3,495,648 | 2/1970 | Amadon | 219/10.55 A |
| 3,786,221 | 1/1974 | Silverman | 219/10.57 |
| 3,990,238 | 11/1976 | Bailey . | |
| 4,064,852 | 12/1977 | Fulenwider, Jr. | 123/549 X |
| 4,089,176 | 5/1978 | Ashe | 60/659 X |
| 4,288,674 | 9/1981 | Councell | 219/10.55 A |
| 4,294,075 | 10/1981 | Closs | 219/10.57 X |

*Primary Examiner*—B. A. Reynolds
*Assistant Examiner*—Philip H. Leung
*Attorney, Agent, or Firm*—Darrell E. Hollis

[57] ABSTRACT

A flash plug for an internal expansion heat engine is heated by electromagnetic microwave energy. The flash plug is an annular ceramic dielectric body having electrically connected metal rings on the inside and a metal sleeve on the outside supplied by a high frequency alternating current.

8 Claims, 3 Drawing Figures

ELECTROMAGNETIC MICROWAVE DIELECTRIC HEATED STEAM FLASH PLUG

BACKGROUND OF THE INVENTION

The present invention relates to an internal expansion heat engine, and more particularly to a flash plug for such an engine.

Internal expansion heat engines are known, and are of either the piston type or the vane type, which pistons or vanes are provided as movable elements within an expansion chamber or chambers. Steam is applied to the expansion chamber or chambers, in order to move the movable elements to cause a shaft to rotate.

To supply steam to the expansion chamber or chambers, steam plugs may be utilized, which are of hollow construction, and which are heated from the outside, and are provided with a spray of water on the inside, the water particles which are sprayed engaging the interior surface of the hollow steam plug, and being converted thereby to steam. The hollow steam plug is connected to the expansion chamber or chambers, and thereby provides steam thereto. The steam plugs are heated by being placed in a fire chamber, where they are exposed to heated gasses and/or flames, which may be generated by a suitable burner, such as an oil burner or a burner for pulverized coal. The hot gasses of combustion are conducted through the fire chamber, where they engage and heat the steam plugs.

A number of proposals in connection with such internal expansion engines have been made. Bailey U.S. Pat. No. 3,990,238 discloses an engine of this type which is provided with a "steam head" which comprises a plurality of heat plates which are in spaced apart relationship, passages between the plates defining steam passages which lead to the expansion chamber of the engine. The plates themselves are heated by electrical resistance coils. Vorel U.S. Pat. No. 1,744,288 discloses a steam engine of the piston type wherein water is supplied through a pipe, and is converted to steam, which is conducted to the pistons, heating of the water being effected by electrical resistance coils. Garland U.S. Pat. No. 1,290,966 is a disclosure of a steam engine in which the piston is provided with electric resistance coils, to cause water sprayed into the cylinder in which the piston moves to be heated into steam. Of general interest is Michelson U.S. Pat. No. 3,400,534 which provides the disclosure of a steam engine which includes spark discharge chambers in which high voltage sparks are discharged between spaced electrodes to heat the water and produce a shock wave. In general, these prior art proposals have been deficient in not providing a satisfactory heated steam generator, and in utilizing no electric heating, or utilizing only electric heating from resistance heaters or spark discharge.

SUMMARY OF THE INVENTION

This invention is directed to an improvement in internal expansion heat engines, and more particularly to the generation of heat for the flash plugs of the engine. The flash plugs are, preferably, heated by combustion gasses, such as from a suitable burner, the flash plugs being hollow and made of dielectric material. Water is sprayed on the interior of the flash plugs, to be converted into steam. Heat is supplied to the flash plug through the medium of dielectric heating, and this is effected by providing a pair of capacitance plates on the interior and exterior of the hollow flash plugs. The capacitance plate on the exterior of the flash plug is in the form of a metal sleeve, and the capacitance plate on the interior of the flash plug is in the form of plurality of axially spaced metal rings which are electrically connected together.

DESCRIPTION OF THE PREFERRED EMBODIMENT

Figure 1:
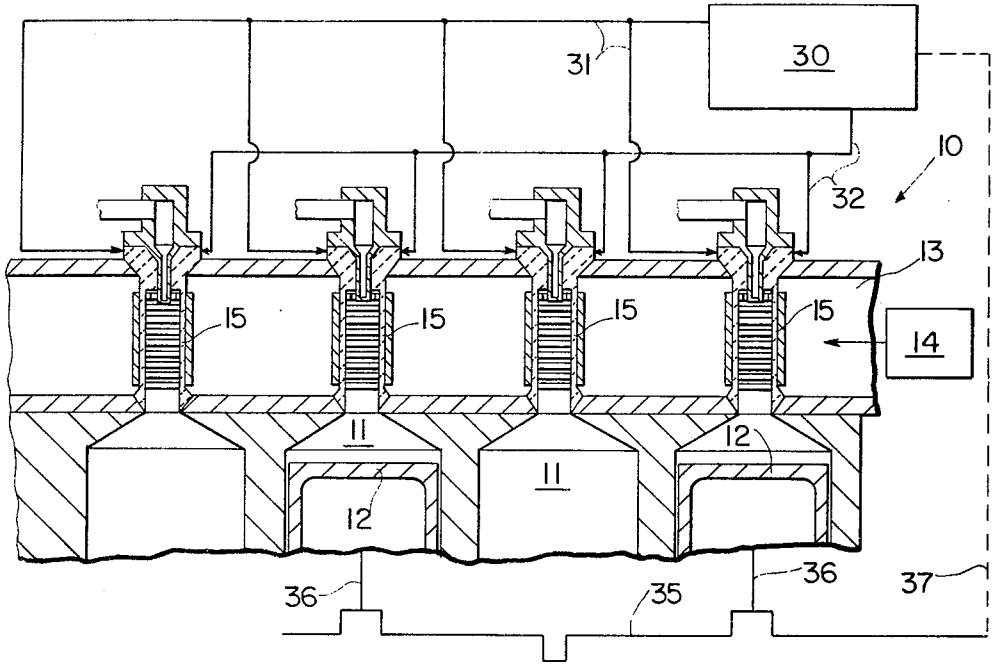
FIG. 1 is a cross-sectional view, partly schematic, of an engine in accordance with the present invention.

Referring now to the drawings, wherein like or corresponding reference numerals are used to designate like or corresponding parts throughout the several views, there is shown in FIG. 1 an internal expansion engine generally designated 10, and comprising a plurality of expansion chambers 11. A movable element, in the form of a piston 12, is shown in one of the expansion chambers 11, the other expansion chambers 11 also containing pistons, not shown in FIG. 1. As will be understood, expansion heat engines may also be in the form of rotary engines, such as turbines or vane type.

Above the expansion chambers 11 is a fire chamber 13, furnished with hot gasses and/or flames from a source 14, which may be a burner. For example, the source 14 may comprise an oil burner or a burner for pulverized coal. The hot gasses thus generated traverse the fire chamber 13.

Extending through the fire chamber 13 are a plurality of hollow flash steam plugs 15.

Figure 2:
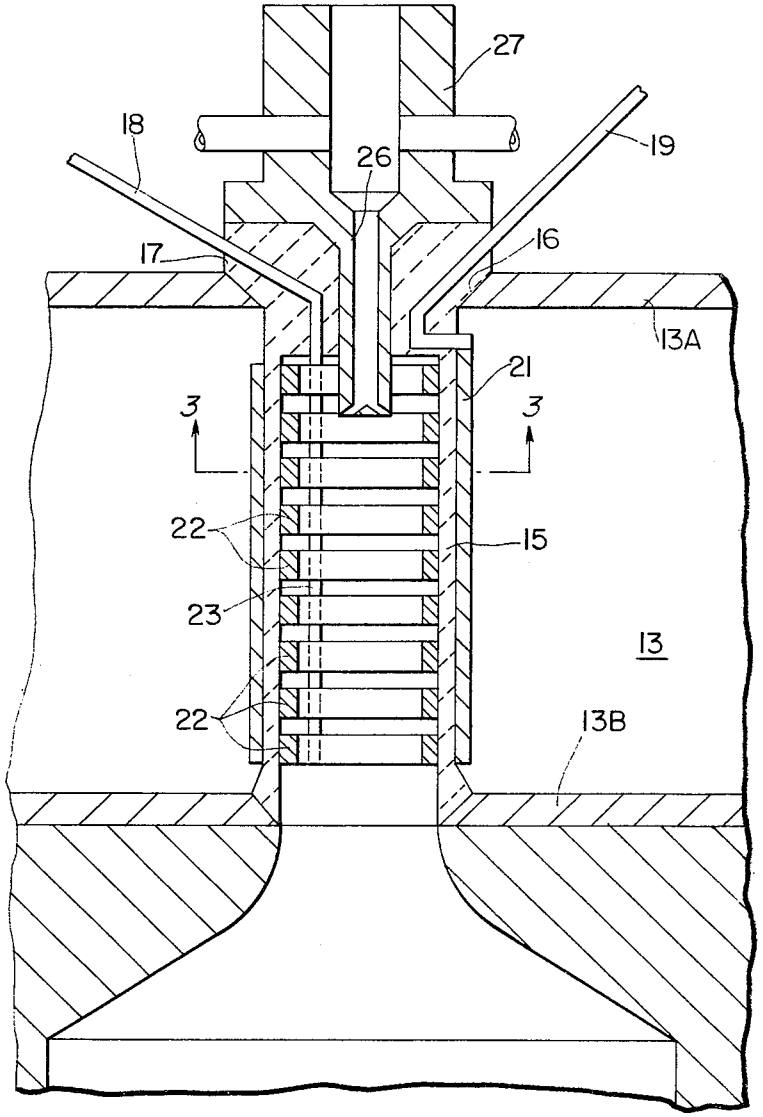
FIG. 2 is an enlarged cross-sectional view, partly schematic, showing the flash plug of the present invention.

Referring to FIG. 2, the hollow steam flash plug 15 may be seen, being made of dielectric material, preferably ceramic. The hollow steam flash plug 15 is annular, and has on the exterior surface thereof a metal capacitance plate 21 in the form of a sleeve. Within the annular flash plug 15 there is a second capacitance plate formed of a plurality of rings 22 which have their axes in substantial coincidence with the axis of the steam flash plug 15. A strip 23 of conductive material electrically connects all of the rings 22 together. The rings 22, which are of metal, are spaced apart, center to center, a multiple of the wave length of alternating current supplied to the two capacitance plates, that is, the capacitance plate 21 and the capacitance plate formed by the rings 22 and the connecting strip 23.

The fire chamber 13 is defined, in part, by metal walls 13A and 13B. In the wall 13A, there is an opening 16, and through the opening 16 there is an extension 17 of the annular ceramic flash plug 15. Extending through extension 17 are conductors 18 and 19 for alternating current, the conductor 19 being connected to the capacitance plate or sleeve 21 and the conductor 18 being connected to the connecting strip 23, and hence to the rings 22.

Also extending through the extension 17 is the nozzle 26 of an injector 27, which serves to inject water into the interior of steam flash plug 15.

Figure 3:
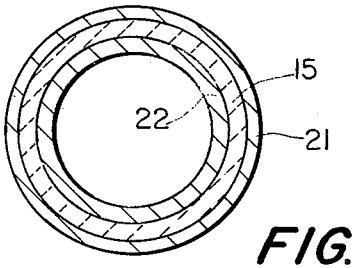
FIG. 3 is a cross-sectional view taken on the line 3—3 of FIG. 2.

In FIG. 3, there may be seen the ceramic annular steam flash plug 15, with the sleeve or capacitance plate 21, and one of the rings 22. As shown, each of these members is annular, and the members are concentric, with the sleeve 21 engaging the exterior of the steam flash plug 15 and with the rings 15 engaging the interior thereof.

Referring again to FIG. 1, there is provided a generator 30 for alternating current of radio frequency, and conductors 31 and 32 serve to connect the generator 30 and the conductors 18 and 19, respectively, to each of the steam flash plugs 15.

Also shown on FIG. 1 is a schematic representation of the crank shaft 35 of the engine 10, several of the piston rods 36 also being schematically illustrated. A power take off, indicated generally by the dashed line 37, extends from the crank shaft 35, to the radio frequency generator 30, so that radio frequency generator 30 during normal operation is driven by a standard alternator driven from the engine 10, itself.

In operation, the source 14 causes heated gasses and/or flames to enter and traverse the fire chamber 15, thereby heating the steam flash plugs 15 therein. Water is supplied to the steam flash plugs 15, from the injector 27, the water entering the heated steam flash plugs 15 and being converted into steam, which is then addmitted to the chambers 11. Heat is also supplied to the steam flash plugs 15 through electromagnetic microwave dielectric heating thereof, and such heating may be either in addition to or in substitution for the heating of the flash plugs 15 by the source 14. More particularly, the generator 30 supplies radio frequency alternating current to the capacitance plates 21 and 22. This causes the molecules of the dielectric material of the steam flash plugs 15 to vibrate and the vibration thereof approaches or equals the frequency of the current from generator 30, thereby generating substantial heat in the dielectric steam flash plug 15. Should there be extraneous microwaves emanating from the capacitance plates 21, 22, or either of them, such microwaves will be confined within the first chamber 13 by the metal walls 30A and 30B thereof, since the fire chamber 13 is a substantially closed metal chamber, and the microwaves will rebound and reflect until they encounter a dielectric steam flash plug 15 and thereby serve to heat the flash plug 15. In this way, substantial efficiency is achieved.

As above noted, the radio frequency generator 30 does not require a source of power, external to the engine herein described, but is driven from an alternator driven from the engine 10.

It will be obvious to those skilled in the art that various changes may be made without departing from the spirit of the invention, and therefore the invention is not limited to what is shown in the drawings and described in the specification but only as indicated in the appended claims.

I claim:

1. A steam flash plug comprising:

a. a non-electrically conductive tubular body having an open discharge end;

b. means for injecting water into said tubular body;

c. means for heating said tubular body with electromagentic microwave energy whereby said injected water is converted into steam when injected into said tubular body; and d. a housing defining an expansion chamber having a movable element therein said expansion chamber having an open end coincident with said tubular body open discharge end whereby said expansion chamber physically expands in volume in response to forces which are generated by the steam and applied to said movable element.

2. The flash plug of claim 1 wherein said injecting means includes a nozzle.

3. The flash plug of claim 1 wherein said heating means includes:

(a) a first capacitance plate disposed adjacent the exterior of said tubular body;

(b) a second capacitance plate disposed adjacent the interior of said tubular body; and (c) means for coupling a microwave voltage to said first and second capacitance plates causing the temperature of said tubular body to increase.

4. The flash plug of claim 3 wherein said first capacitance plate includes a sleeve.

5. The flash plug of claim 3 wherein said second capacitance plate includes a plurality of spaced-apart, electrically-interconnected rings.

6. The flash plug of claim 5 wherein said spaced-apart rings are spaced apart a multiple of the wavelength of said microwave voltage.

7. The flash plug of claim 1 further includes means for preheating said tubular body.

8. The flash plug of claim 7 wherein said preheating means includes:

(a) a jacket, defining a fire chamber, surrounding said tubular body; and (b) a combustion burner cooperating with said fire chamber to pass hot gasses through said fire chamber.

* * * * *